US005516982A

United States Patent [19]

Takeuchi et al.

[11] Patent Number: 5,516,982

[45] Date of Patent: May 14, 1996

[54] DEVELOPING APPARATUS HAVING DEVELOPER REGULATING MEMBER

[75] Inventors: Youichi Takeuchi; Yasuyuki Tsuji; Shuuho Yokokawa; Kunitomo Takahashi; Youji Hirose; Hiroshi Ueno; Kouji Doi; Koutaro Yamada; Yoshio Ogura, all of Ibaraki, Japan

[73] Assignee: Hitachi Koki Co., Ltd., Tokyo, Japan

[21] Appl. No.: 348,295

[22] Filed: Dec. 2, 1994

[30] Foreign Application Priority Data

Dec. 3, 1993 [JP] Japan ..... 5-304232

[51] Int. Cl.[6] ..... G03G 15/09

[52] U.S. Cl. ..... 118/661; 355/251; 118/658

[58] Field of Search ..... 355/251, 253, 355/259; 118/656–658, 651, 661

[56] References Cited

U.S. PATENT DOCUMENTS

| | | | |
|---|---|---|---|
| 4,063,533 | 12/1977 | White | 118/658 |
| 4,235,193 | 11/1980 | Groen et al. | 118/658 |
| 4,266,868 | 5/1981 | Bresina et al. | 118/657 X |
| 4,398,496 | 8/1983 | Kopko | 118/658 |
| 4,400,078 | 8/1983 | Mayer | 118/658 X |
| 4,447,518 | 5/1984 | Tabuchi | 118/657 X |
| 4,671,641 | 6/1987 | Kohyama | 355/251 |
| 4,766,458 | 8/1988 | Oka et al. | 118/657 X |
| 4,771,311 | 9/1988 | Bray | 355/251 |
| 4,872,036 | 10/1989 | Homma | 355/253 |
| 4,912,511 | 5/1990 | Murasaki | 355/251 X |
| 4,952,979 | 8/1990 | Koefferlein et al. | 355/251 |
| 4,982,223 | 1/1991 | Yahita | 355/251 |

FOREIGN PATENT DOCUMENTS

| | | |
|---|---|---|
| 59-026372 | 7/1984 | Japan . |
| 2-008308 | 2/1990 | Japan . |

*Primary Examiner*—Robert Beatty

*Attorney, Agent, or Firm*—Sughrue, Mion, Zinn, Macpeak & Seas

[57] ABSTRACT

Regulating parts E, F, of a developing agent regulating member 6, are arranged opposite to a photosensitive drum 7 with respect to a line connecting the centers of a developing roll 5 having a sleeve rotating in the direction of a and a developing roll 8 having a sleeve rotating in the direction of b. Holding members 10 which are slidable on the side plate of a developing apparatus are respectively provided at both ends of the developing agent regulating member. Developing agent is supplied from developing roll 5 to developing roll 8 through a back surface of the developing agent regulating member 6.

4 Claims, 2 Drawing Sheets

DEVELOPING APPARATUS HAVING DEVELOPER REGULATING MEMBER

BACKGROUND OF THE INVENTION

1. Field of the Invention

The present invention relates to a developing apparatus for an electrophotographic device, and more particularly to a center-feed type developing apparatus.

2. Description of the Related Art

Referring to FIG. 1, a conventional center-feed type developing apparatus will be described.

The conventional center-feed type developing apparatus includes two developing rolls 5 and 8 which are set opposite to a photosensitive drum 7 in a developing container 1 in such a manner that the two developing rolls are rotatable in different directions. The developing apparatus also includes a developing agent 3 in the developing container 1 which is drawn up by a conveyor roll (unnumbered) toward the developing rolls 5 and 8 and regulated by a first developing agent regulating member 11 before being distributed by a second developing agent regulating member 12 to the developing rolls 5 and 8.

With the arrangement described above, the second developing agent regulating member 12 is provided on the side of the photosensitive drum 7 with respect to a line connecting the centers of the developing rolls 5, 8 as a boundary. Consequently, the toner which has scattered tends to accumulate on the surface of the second developing agent regulating member opposite to the photosensitive drum 7 (a portion D). The toner that has accumulated on the portion D falls in drops on the developing roll 5 by its own weight and leaves a toner stain on recording paper. The toner that has fallen on the developing roll 5 may spoil images or stick to the photosensitive drum 7, thus causing a fog.

In order to deal with this problem, Japanese Patent Examined Publication No. Hei 2-8308 discloses a method of preventing the accumulation of a toner by contriving to arrange the magnetic flux of developing magnetic poles so as to let a developing agent 3 fall on the part D of a second developing agent regulating member 12. On the other hand, Japanese Utility Model Examined Publication No. Sho 59-26372 discloses, as shown in FIG. 2, a method of preventing the accumulation of a toner by fitting a film 13 to a second developing agent regulating member 12, the film 13 being caused to vibrate by contact with a developing agent layer.

As set forth above, the prior art center-feed type developing apparatus is equipped with the developing agent regulating member which is located on the photosensitive drum side with respect to the line connecting the centers of two developing rolls as a boundary. As a result, the scattered toner easily accumulates on the opposite surface of the developing agent regulating member to the photosensitive drum, thus causing a fog as well as the deterioration of image quality.

Since the developing agent regulating member is installed in a small space between the two developing rolls, rigidity essential to regulating the developing agent is unavailable in the case of a developing apparatus designed to deal with broad recording paper, which results in an unstable regulated quantity of the developing agent.

SUMMARY OF THE INVENTION

It is therefore an object of the present invention to provide a developing apparatus capable of improving printing quality by preventing a toner from piling up on a developing agent regulating member to stabilize the quantity of a developing agent to be supplied to developing rolls.

In order to achieve the above object, a developing apparatus for an electrophotographic device according to the present invention which comprises a developing container, not less than two developing roll members which are contained in the developing container, arranged opposite to a photosensitive drum and have a magnetic attraction force, at least two of the developing roll members being rotatable in different directions, and a developing agent regulating member in between the two developing rolls which are set to rotate in different directions, the developing agent regulating member having a regulating portion for regulating the thickness of a developing agent layer to be distributed to the two developing roll members. The regulating portion is located opposite to the photosensitive drum with respect to a line connecting the centers of the two developing roll members as a boundary.

With the arrangement above, even though a scattered toner tends to pile up on the developing agent regulating member, it is removed by the flow of a developing agent being conveyed to developing rolls.

The nature, utility and principle of the invention will be more clearly understood from the following detailed description and the appended claims when read in conjunction with the accompanying drawings.

DETAILED DESCRIPTION OF THE PREFERRED EMBODIMENTS

Figure 1:
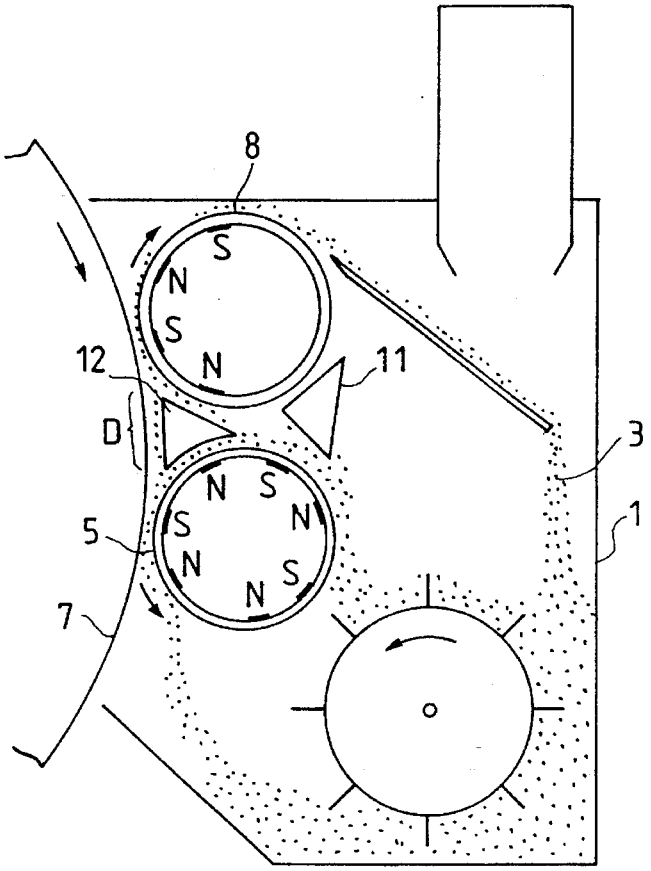
FIG. 1 PRIOR ART
FIG. 1 is a sectional view showing one conventional developing apparatus for an electrophotographic device.
Figure 2:
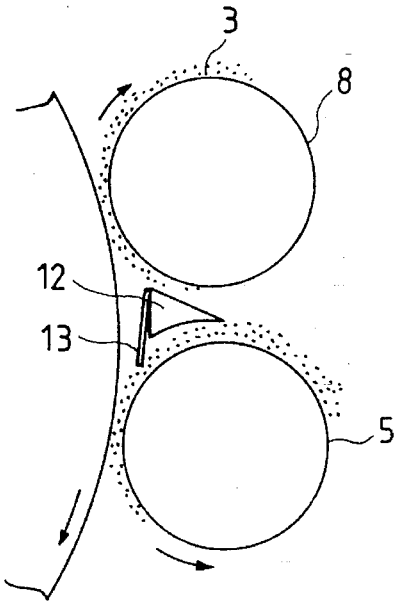
FIG. 2 PRIOR ART
FIG. 2 is a sectional view of another conventional developing apparatus for an electrophotographic device.

Referring to the drawings, an embodiment of the present invention will subsequently be described.

Figure 3:
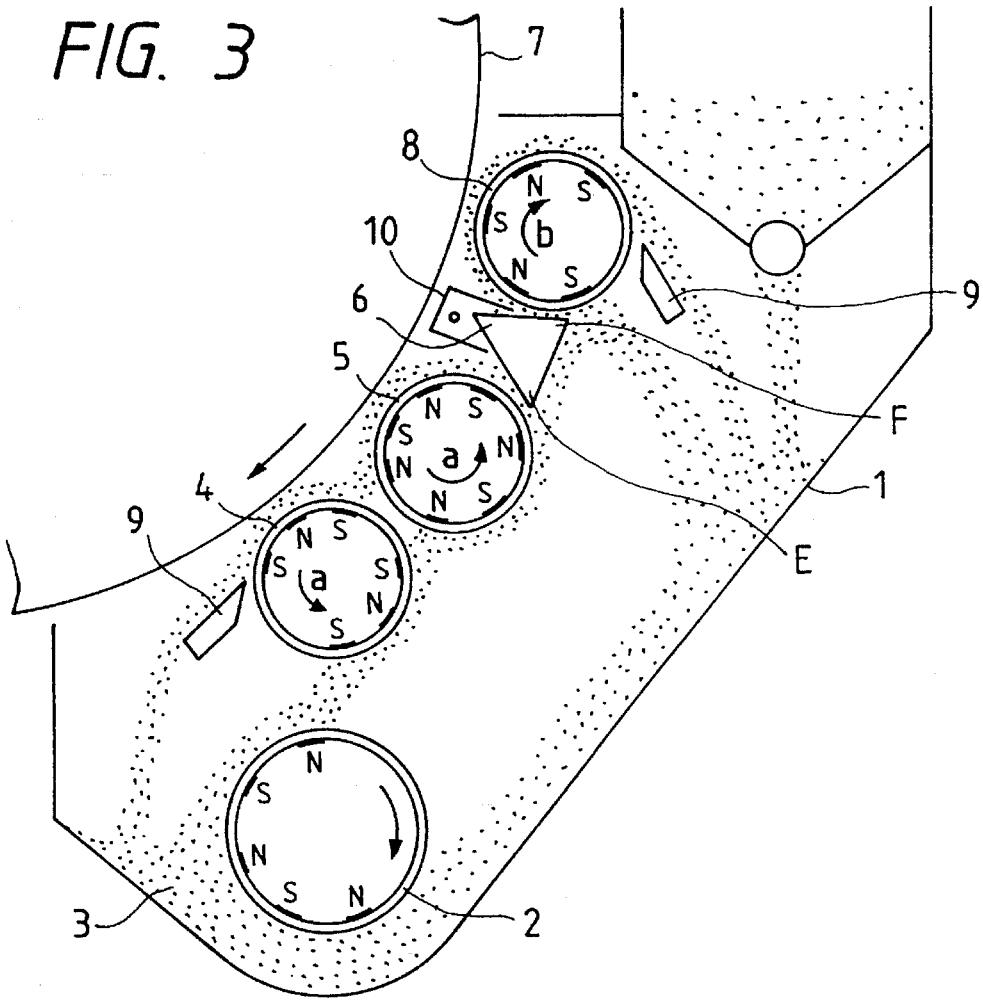
FIG. 3 is a sectional view showing a developing apparatus for an electrophotographic device according to the present invention.

FIG. 3 is a sectional view of a developing apparatus embodying the present invention. A conveyer roll 2 (magnet roll) is contained in the lower part of a developing container 1 and developing rolls 4, 5 and 8 are located opposite to a photosensitive drum 7 therein. A developing agent 3 as a mixture of a carrier and a toner on the bottom of the developing container 1 is conveyed by the conveyer roll 2 and delivered to the developing roll 5 while it is sticking to the surface of a sleeve which rotates in the direction of a (in the opposite direction to that of the rotation of the photosensitive drum 7) due to the magnetic attraction force of the developing roll 4. While sticking to the surface of the sleeve rotating in the direction of a due to the magnetic attraction force of the developing roll 5, the developing agent 3 thus delivered is further conveyed up to a part E of a developing agent regulating member 6 so that it is restricted to a fixed quantity. The developing agent 3 thus regulated is conveyed to a developing area where the photosensitive drum 7 and the developing rolls 4 and 5 are set opposite to each other. It is in this area that the developing agent 3 contributes to the developing process.

The developing agent that has escaped from the quantity restriction in the part E is passed on the back of the developing agent regulating member 6 and delivered to the developing roll 8 having a sleeve which rotates in the direction of b which is opposite to the direction of rotation of the developing rolls 4 and 5 (the same direction as the direction of rotation of the photosensitive drum 7) before being conveyed further while it is sticking to the surface of the sleeve because of the magnetic attraction force. Then the developing agent is regulated by a part F of the developing regulating member 6 (see FIG. 4) so that it is restricted to a fixed quantity and conveyed to a developing area where the photosensitive drum 7 and the developing roll 8 are set opposite to each other. It is also in this area that the developing agent contributes to the developing process. The developing agent that has escaped from the quantity restriction in the part F of the developing agent regulating member 6 is dropped down in the developing container 1. The developing agent that has passed through the developing area is scraped off the developing rolls 4 and 8, respectively, by means of scrapers 9 and returned into the developing container 1.

Figure 4:
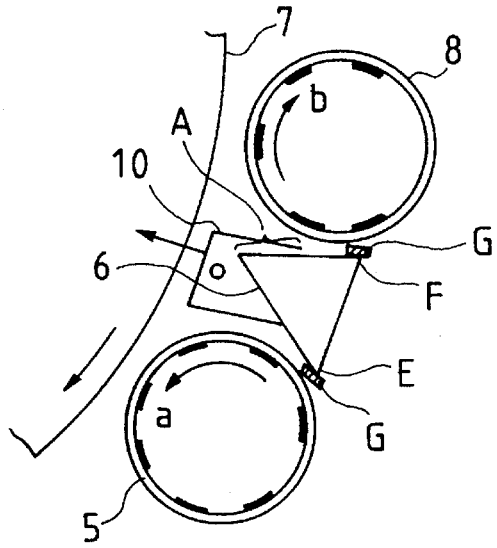
FIG. 4 is an enlarged view showing a developing agent regulating member.

FIG. 4 is an enlarged view of the developing agent regulating member. The regulating parts E and F of the developing agent regulating member 6 are disposed opposite to the photosensitive drum 7 with respect to a line connecting the centers of the developing rolls 5 and 8 as a boundary. The toner scattering from the developing rolls 5 and 8 tends to gather on the developing agent regulating member 6, particularly in a portion A of FIG. 4. However, the toner which tends to gather in the portion A is removed by the flow of the developing agent being conveyed to the developing roll 8.

A pair of holding members 10 which are slidable on a side plate (not shown) of the developing apparatus are secured to both ends of the developing agent regulating member 6 with, for example, screws so as to support the respective ends thereof. On the other hand, the side plate of the developing apparatus is provided with a pair of projections G set with a predetermined space or distance apart from the developing rolls 5, 8 and the distance between the pair of projections G is set equal to the distance between the parts E and F of the developing agent regulating member 6. When the developing agent regulating member 6 is fitted to the developing apparatus, the holding members 10 are slid on the side plate of the developing apparatus and then fixed to the side plate with the screws at the position where the parts E and F of the developing agent regulating member 6 are made to abut against the respective projections G. With the arrangement above, the developing agent regulating member 6 can readily be fitted to the developing apparatus without using jigs and the like and the gap between the developing rolls 5, 8 and the developing agent regulating member 6 can also be adjusted with ease.

Since the regulating portion of the developing agent regulating member 6 is located opposite to the photosensitive drum with respect to the line connecting the centers of two developing roll members whose directions of rotation are different, the toner scattering over the developing agent regulating member 6 is prevented from gathering. Moreover, the regulating portion of the developing agent regulating member 6 which is located in a wide space opposite to the photosensitive drum results in making available rigidity necessary for regulating the developing agent and stabilizing the regulated quantity of the developing agent. Therefore, a more stable printing quality is obtained.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A developing apparatus for an electrophotographic device, the electrophotographic device including a photosensitive body rotatably driven in a predetermined direction, said developing apparatus comprising:

a developing roll group which opposes the photosensitive body and has at least two developing rolls including a first developing roll which rotates in a direction reverse to that of the photosensitive body and a second developing roll which rotates in the same direction as that of the photosensitive body;

a developer regulating member having a regulating portion for regulating a thickness of a developer to be supplied to said first and second developing rolls, said regulating portion being disposed opposite to the photosensitive body with respect to a line connecting centers of said first and second developing rolls;

a transfer roll for supplying the developer to one of said first and second developing rolls which form said developing roll group; and a developer transfer path through which a part of the developer which is supplied to said first developing roll is delivered to said second developing roll through a back surface of said developer regulating member.

2. A developing apparatus for an electrophotographic device as claimed in claim 1, further comprising a side plate of said developing apparatus, and a pair of holding members for holding said developer regulating member, said holding members being slidable with respect to said side plate.

3. A developing apparatus for an electrophotographic device as claimed in claim 2, wherein said side plate includes a pair of projections, each projection being spaced at a predetermined distance apart from a corresponding one of said first and second developing rolls.

4. A developing apparatus for an electrophotographic device as claimed in claim 1, further comprising a scraper for scraping off developer which has passed through a developing area from each of said first and second developing rolls and returning it into said developing container.

* * * * *